US009551078B2

(12) United States Patent
Yang et al.

(10) Patent No.: US 9,551,078 B2
(45) Date of Patent: Jan. 24, 2017

(54) ELECTROLYTIC CELL FOR PRODUCING PRIMARY ALUMINUM BY USING INERT ANODE

(75) Inventors: Jianhong Yang, Zhengshou (CN); Wangxing Li, Zhengshou (CN); Peng Cao, Zhengshou (CN)

(73) Assignee: ALUMINUM CORPORATION OF CHINA LIMITED, Beijing (CN)

( * ) Notice: Subject to any disclaimer, the term of this patent is extended or adjusted under 35 U.S.C. 154(b) by 1015 days.

(21) Appl. No.: 13/575,952

(22) PCT Filed: Sep. 27, 2010

(86) PCT No.: PCT/CN2010/077349

§ 371 (c)(1),
(2), (4) Date: Jul. 28, 2012

(87) PCT Pub. No.: WO2011/072544

PCT Pub. Date: Jun. 23, 2011

(65) Prior Publication Data

US 2012/0318667 A1 Dec. 20, 2012

(30) Foreign Application Priority Data

Dec. 18, 2009 (CN) ..... 2009 1 0243384

(51) Int. Cl.
*C25B 9/00* (2006.01)
*C25C 1/02* (2006.01)
(Continued)

(52) U.S. Cl.
CPC .. *C25C 3/08* (2013.01); *C25C 3/06* (2013.01)

(58) Field of Classification Search
CPC ..... C25B 9/00; C25C 1/02; C25C 3/08; C25C 7/00; C25C 3/00; C25C 3/06; C25C 3/10; C25C 3/12; C25C 3/14; C25C 7/02; C25C 7/025; C25C 7/005
(Continued)

(56) References Cited

U.S. PATENT DOCUMENTS 4,592,821 A * 6/1986 Keinborg et al. ..... 204/244
6,287,447 B1 * 9/2001 de Nora ..... C04B 41/009 205/378
(Continued)

FOREIGN PATENT DOCUMENTS

CN 2045742 U 10/1989
CN 1479809 A 3/2004
(Continued)

*Primary Examiner* — Zulmariam Mendez
(74) *Attorney, Agent, or Firm* — Cheng-Ju Chiang

(57) ABSTRACT

An electrolytic cell for producing primary aluminum by using inert anodes is disclosed, in which an electrolyte system KF—NaF—$AlF_3$ is used and the operating temperature of the cell is 700-850° C. The electrolytic cell comprises a cell shell, heat insulating refractory lining, a melting pot, a heat insulating cover, inert electrodes, electrode stems, anode bus-bars, cathode bus-bars, anode branching bus-bars, heat insulating plates, partitions between anodes and cathodes and a feeding device. The quality of the aluminum product obtained by using the electrolytic cell is not less than 99.7%. The cell is free from emission of carbon dioxide and perfluorinated compounds (PFCs), and hardly has consumption of electrodes, so the distances between anodes and cathodes can be kept stable. The cell is sealed and the volatilization of dust and fluorides can be prevented, and it is useful to recover oxygen gas.

22 Claims, 4 Drawing Sheets

(51) Int. Cl.

| | |
|---|---|
| ***C25C 3/00*** | (2006.01) |
| ***C25C 3/06*** | (2006.01) |
| ***C25C 3/08*** | (2006.01) |
| ***C25C 3/10*** | (2006.01) |
| ***C25C 3/12*** | (2006.01) |
| ***C25C 3/14*** | (2006.01) |
| ***C25C 7/00*** | (2006.01) |
| ***C25C 7/02*** | (2006.01) |

(58) Field of Classification Search
USPC ..... 204/242, 263; 205/372
See application file for complete search history.

(56) References Cited

U.S. PATENT DOCUMENTS

| | | | | |
|---|---|---|---|---|
| 6,419,812 | B1 * | 7/2002 | Beck | C25C 3/06 205/374 |
| 6,866,768 | B2 | 3/2005 | Bradford et al. | |
| 7,678,244 | B2 * | 3/2010 | Despinasse et al. | 204/242 |
| 2003/0010628 | A1 | 1/2003 | De Nora et al. | |
| 2003/0209426 | A1 | 11/2003 | Kozarek et al. | |
| 2008/0041729 | A1 * | 2/2008 | De Nora | C25C 3/12 205/380 |
| 2009/0114547 | A1 * | 5/2009 | Nguyen | C25C 3/12 205/372 |
| 2009/0166215 | A1 * | 7/2009 | Beck | 205/384 |

FOREIGN PATENT DOCUMENTS

| | | | | |
|---|---|---|---|---|
| CN | 2711179 | Y | 7/2005 | |
| CN | 1673417 | A | 9/2005 | |
| CN | 1673418 | A | 9/2005 | |
| CN | 1917933 | A | 2/2007 | |
| CN | 1986898 | A | 6/2007 | |
| CN | 101307566 | A | 11/2008 | |
| CN | 101619469 | * | 1/2010 | C25D 3/14 |
| CN | 101709485 | A | 5/2010 | |

* cited by examiner

ELECTROLYTIC CELL FOR PRODUCING PRIMARY ALUMINUM BY USING INERT ANODE

CROSS REFERENCE TO RELATED APPLICATIONS

The present application is a 35 U.S.C. §371 National Phase conversion of International (PCT) Patent Application No. PCT/CN2010/077349, filed on Sep. 27, 2010, the disclosure of which is incorporated by reference herein. The PCT International Patent Application was published in Chinese.

TECHNICAL FIELD

The present invention relates to the technical field of aluminum electrolysis, in particular to an electrolytic cell for producing primary aluminum by using inert anode.

BACKGROUND OF THE INVENTION

The cryolite-aluminum oxide aluminum fusion electrolysis is the only aluminum production method in the aluminum industry all the time. As for the current Hall-Herout electrolytic cell, the electrolytic temperature commonly is often 940-960° C.; the comprehensive electric power consumption is 13.5 kw-15.0 kW·h/kg (A1); and the power efficiency is less than 50%. At the same time, large quantity of greenhouse gasses, such as $CO_2$ and CFn, and carcinogenic substances are generated, resulting in severe environmental pollution. The development of the aluminum industry is seriously limited by the large energy consumption, resource consumption, environmental load and so on. The energy saving, consumption reduction and pollution reduction are development directions of the aluminum industry in the future.

The replacement of carbon anode with the inert anode not only saves anode carbon consumption of 400 kg-500 kg/t·Al (the carbon anode accounts for 12%-15% of production cost of aluminum), but also reduces the carbon tax brought by the emission of equivalent $CO_2$. After the inert anode is adopted, $CO_2$, CO and CFn are not emitted anymore; at the same time, the $O_2$ emitted by the anode can be used as byproduct. Therefore, as for the electrolytic aluminum industry with high emission, the adoption of aluminum electrolysis process by using inert anode is of great importance. If the inert anode is jointly used with the wettable cathode, 20%-30% energy consumption can be reduced, improving the energy efficiency. At the same time, the design of efficient and green electrolytic cell can largely increase the production capacity of unit floor space and reduce the volume of electrolytic cell to improve the energy production efficiency, significantly reduce the investment cost and reduce the cost of primary aluminum.

An electrolytic cell with horizontal current has been published by Chinese Patent No. CN200810049240.5, Chinese Patent No. CN 89210028.1 and U.S. Pat. No. 6,866,768. However, the cell structure is only described in concept, the specific and detailed description is absent, and it is difficult to realize the aluminum production in the highly corrosive fluoride fusant by means of electrolytic cell with horizontal current.

Although the method for producing aluminum by electrolysis and the electrolytic cell for the potassium cryolite fused salt system is raised by Chinese Patent CN200510011143.3, the cell structure is only described in concept; no specific description and specific connection mode between the electrode and steam are provided; no specific method for protecting the steam and avoiding the oxidization in the high-temperature oxygen atmosphere is provided; no specific heat preservation measure is involved. An electrolytic cell with cathode groove is published by Chinese Patent CN200420060680.8 and Chinese Patent CN200510011142.9. However, the electrolytic cell with cathode groove is only aimed at the electrolytic cell for traditional aluminum electrolysis process.

An electrolytic cell with inert electrode is published by Chinese Patent CN200610051288.0. The electrolytic cell with inert electrode is an electrolytic cell, where the plate-like metal ceramic inert anode is connected in parallel with the wettable cathode and is perpendicularly and parallelly set up. However, a feasible and effective electrolytic cell for the alloy anode is not raised.

Electrolytic cells involved in above-mentioned patents are open electrolytic cells. No sealing measure is adopted, which is adverse to the oxygen collection; no specific connection mode between the electrode and the steam is provided; no specific method for protecting the steam and avoiding the oxidization in the high-temperature oxygen atmosphere is provided; no specific heat preservation measure is involved; and aluminum-free level operation can not be achieved by the cathode with groove.

SUMMARY OF THE INVENTION

In according to the deficiency of the above-mentioned existing techniques, the present invention aims to provide an electrolytic cell for producing primary aluminum by using inert anode, so that it has advantages of oxygen collection, the oxidation of the steam can be effectively prevented, and the aluminum-free level operation can be realized.

According to one aspect, the present invention relates to an electrolytic cell for producing primary aluminum by using inert anode comprises at least one group of column electrodes fixed in the electrolytic cell, a bus-bar, at least an electrode stem, a heat insulating plate, a partition between anode and cathode, and a sealing plate; said electrode group comprises at least 2 electrodes; single said electrode comprises an inert anode and a cathode, which is arranged in the form of "-inert anode-cathode-inert anode-" or "-cathode-inert anode-cathode-"; said bus-bar comprises an anode bus-bar, a cathode bus-bar, an anode branching bus-bar and a cathode branching bus-bar; the anode/branching bus-bar and the cathode branching bus-bar of each said electrode group are arranged in the form of "-anode branching bus-bar-cathode branching bus-bar-anode branching bus-bar-" or "-cathode branching bus-bar-anode branching bus-bar-cathode branching bus-bar-"; the single-ended power supply mode is adopted for said group of column electrodes: the single-ended power supply mode is formed by one anode bus-bars (power input end) and one cathode bus-bars (power output end), the two ends of the anode branching bus-bar are respectively fixed on the anode bus-bar, the two ends of the cathode branching bus-bar are respectively fixed on the cathode bus-bar, and the insulating strips are used for insulation of the interface between the anode branching bus-bar and the cathode bus-bar, and the base plane between the cathode branching bus-bar and the anode bus-bar. The two-ended power supply mode is also adopted for said group of column electrodes: the two-ended power supply mode is formed by two anode bus-bars and the cathode bus-bars, the group of column electrodes is divided into two layers, where one is the anode bus-bar and the other is cathode bus-bar, the two ends of the anode branching bus-bar are respectively fixed on the anode bus-bar, and the two ends of the cathode branching bus-bar are respectively fixed on the cathode bus-bar; single said electrode is connected with said anode branching bus-bar or said cathode branching bus-bar through said electrode stem; said heat insulating plate is fixed above said inert anode and said heat insulating plate is provided with via holes, through which said electrode stem can pass through said heat insulating plate; said partition between anode and cathode is fixed under said sealing plate and in the middle of the electrodes, and it is closely arranged with said heat insulating plate, so as to ensure the electrode distance; said sealing plate is overlapped between said anode branching bus-bar and said cathode branching bus-bar.

The lower end of said electrode stem can be connected with said inert anode and said cathode by bolt joint.

The upper end of said electrode stem is connected with said anode branching bus-bar or said cathode branching bus-bar by bolt joint, compression joint, casting or welding.

Said electrode stem is made of stainless steel, heat-resisting alloy or anti-corrosion copper alloy.

A protecting tube is fixed at the outside of said electrode stem, and the interspace between said protecting tube and said electrode stem is filled with aluminum oxide.

Said protecting tube is made of the alundum tube, the carborundum tube or other anti-corrosion and heat-resisting materials.

The outside of said electrode stem is protected with the quadrate heat insulating material that is provided with via holes in the middle.

Said heat insulating plate is made of heat-insulation and anti-corrosion ceramics; and the width and thickness of said heat insulating plate are the same as those of the electrode.

Said partition between anode and cathode is made of heat-insulation and anti-corrosion ceramics; the width of said partition between anode and cathode is the same as that of the electrode; the thickness of said partition between anode and cathode is equal to the electrode distance; and said partition between anode and cathode is suspended under said sealing plate.

Said sealing plate is the steel plate, and said sealing plate is compacted on said anode branching bus-bar and said cathode branching bus-bar by means of the weight of the partition between anode and cathode or the fixtures; said sealing plate is compacted between said anode branching bus-bar and said cathode branching bus-bar with a gasket.

Said gasket comprises the high-temperature rubber, the inorganic adhesive or inorganic felt and so on.

Said inert anode is made of the metal alloy; said cathode is the $TiB_2$ composite ceramics, the carbon block, of which the surface is covered with the $TiB_2$ coating, or other boride composite cathodes.

The electrode distance of said electrode is 10 mm~80 mm.

Said anode branching bus-bar is insulated with said cathode bus-bar with the spacer made of polytetrafluoroethylene or other insulating materials.

Said cathode branching bus-bar is insulated with said anode bus-bar with the spacer made of polytetrafluoroethylene or other insulating materials.

Said inert anode and said cathode are perpendicularly and parallelly fixed in the electrolytic cell in a parallel manner.

Further, said electrolytic cell comprises a cell lining, said cell lining is built with the refractory and heat insulating material coating, and the inside cavity of the upper end of said cell lining is in the expanding diameter step shape.

Further, said electrolytic cell comprises a melting pot, said melting pot is located in the middle part of the cell, and the outer wall of said melting pot is fitted with said cell lining.

Further, said electrolytic cell comprises a heat insulating cover for the melting pot, the bottom of said heat insulating cover for the melting pot is covered on the top edge of the melting pot and on the step surface of said cell lining, and the upper end of the heat insulating cover for the melting pot is flush with said cell lining in height.

Said heat insulating cover for the melting pot is the quadrate cover or circular cover.

Said heat insulating cover for the melting pot is made of the heat-insulation and anti-corrosion alumina ceramics, high alumina cement, anti-corrosion nitride or carbide materials.

There is an aluminum collector groove at the bottom of said melting pot as well as under said cathode shadow, there is a storage aluminum pool at one end of said melting pot bottom, said aluminum collector groove is connected with said storage aluminum pool through a diversion groove, and the bottom of said melting pot is also an inclined plane, through which molten aluminum can flow into the diversion groove fixed in the middle part or at both sides of the melting pot and can be collected into the storage aluminum pool.

Said cell shell is provided with a feeding opening, said feeding opening is located in the middle part or lateral part of the electrolytic cell, or is also located in the middle part and lateral part of the electrolytic cell, and the point-type feeding or line-type feeding is adopted, or the point-type feeding and line-type feeding are combined.

Said feeding opening is fixed with a crustbreaking feeding device, and the lower end of said crustbreaking feeding device is fixed with a crustbreaking heat-insulation and anti-radiance plate.

Said crustbreaking heat-insulation and anti-radiance plate is made of heat-resisting stainless steel or other heat-resisting and anti-corrosion materials, and it is fixed on the connecting rod between the crustbreaking hammerhead and the crustbreaking cylinder and it can be placed one or more.

The present invention provides an electrolytic cell for producing primary aluminum by using inert anodes, compared with the traditional aluminum electrolysis process, which is green environmental protection, the cell is from emission of $O_2$ and free from emission of $CO_2$ and PFCs (perfluorinated compounds), hardly has consumption of electrodes, so the yearly corrosion rate is low, the distances between the anodes and cathodes can be kept stable, the interference on the current distribution and heat balance is avoided due to the anode replacement, and the cell is easy to be controlled; the electrolytic cell has good heat insulation effect, increased heat efficiency, and reduced heat loss; no carbon processing plant needs to be additionally constructed, reduced the cost and the replacement frequency of anodes, as well as the amount of operating human; the metal quality of the product is increased, so that the product quality of primary aluminum is not less than 99.7% after the inert electrode is used, and increased space utilization rate and capacity in unit volume or unit floor space of the cell; the electrolytic cell is free of tank leakage, and it has long service life; the electrolytic cell is sealed and the volatilization of dust and fluorides can be prevented, and it is useful to recover oxygen gas.

DETAILED DESCRIPTION OF THE PRESENTLY PREFERRED EMBODIMENTS

Embodiment 1

Figure 1:
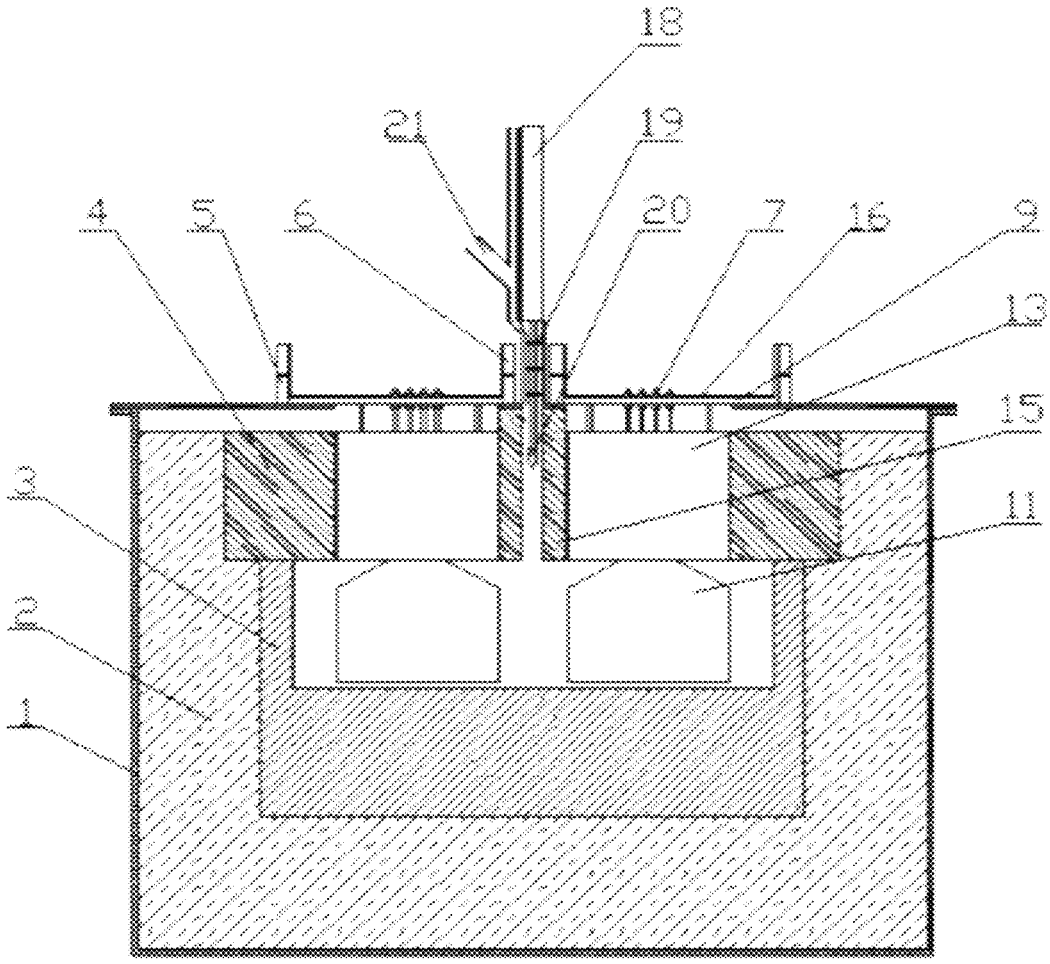
FIG. 1 is the front structural sectional view for an electrolytic cell for producing primary aluminum by using inert anode provided in the embodiment 1 of the present invention.
Figure 2:
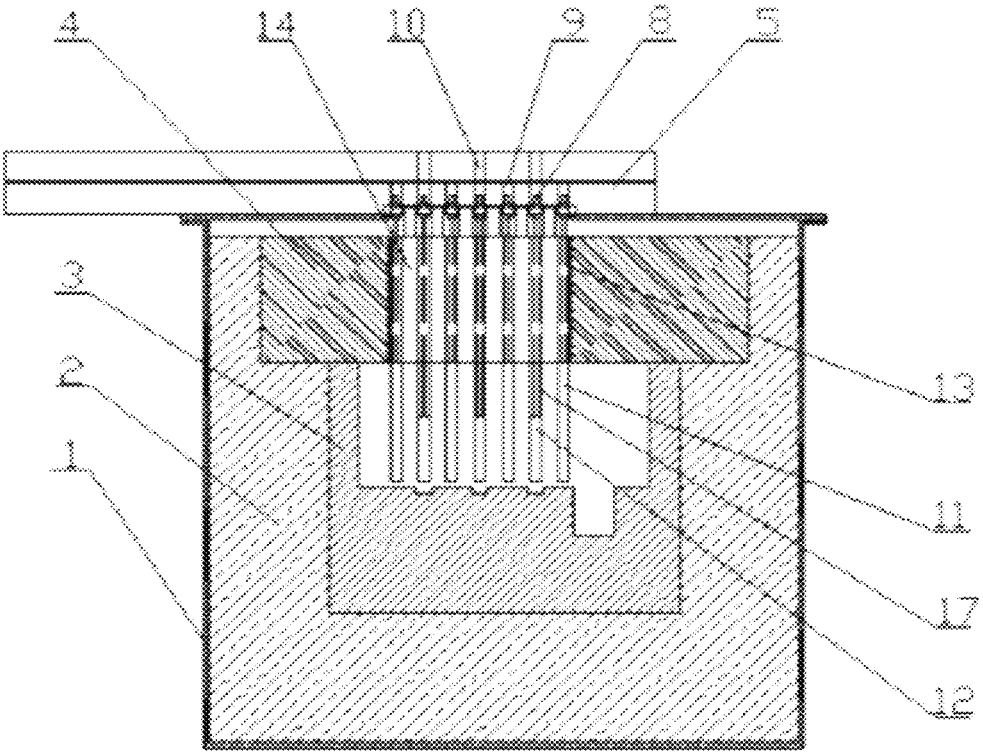
FIG. 2 is the side structural sectional view for an electrolytic cell for producing primary aluminum by using inert anode provided in the embodiment 1 of the present invention.

As shown in FIG. 1 and FIG. 2, the present invention embodiment provides an electrolytic cell for producing primary aluminum by using inert anodes, in which an electrolyte system KF—NaF—$AlF_3$ is used and the operating temperature of the cell is 700-850° C. The electrolytic cell comprises a cell shell 1, a melting pot 3, a heat insulating cover for melting pot 4, a cell lining 2, at least one group of column electrodes fixed in the electrolytic cell, a bus-bar, at least an electrode stem, a heat insulating plate 13, a partition between anode and cathode 14, a heat insulating plate in the feeding area 15, a sealing plate 16, a crustbreaking cylinder 18, a crustbreaking heat-insulation and anti-radiance plate 19, a crustbreaking hammerhead 20 and a feeding tank 21.

Furthermore, a molten pool of the electrolytic cell is composed of the cell shell 1, the cell lining 2, the melting pot 3 and the heat insulating cover for melting pot 4. The cell shell 1 is a closed shell made of steel plate, which is provided with the electrode port and feed opening on the upper part. The cell lining is built with the refractory heat insulating material coating 2 as well as the inner bottom surface and lateral surface of the cell shell. The inside cavity of the upper end of the cell lining is in the expanding diameter step shape. The heat insulating cover for melting pot 4 is made of heat-insulation and anti-corrosion alumina ceramics, high alumina cement or anti-corrosion nitride, carbide material and so on. The heat insulating cover for melting pot 4 is covered on the melting pot 3 for heat insulating. The melting pot 3 is spliced with the heterogenic anti-corrosion internal lining material blocks or bricks. The melting pot 3 is located in the middle part of the cell, and the outer wall of the melting pot is fitted with the cell lining. An aluminum collector groove is provided under the cathode shadow 12. One end of the melting pot 3 is provided with a storage aluminum pool. The aluminum collector groove and the storage aluminum pool are connected with a diversion groove. The molten aluminum generated by the electrolysis flows into the aluminum collector groove, passes through the diversion groove, and finally flows into the storage aluminum pool. Therefore, the aluminum-free level operation or low aluminum level operation can be realized. The heat insulating cover for melting pot 4 can be a quadrate cover or circular cover. The bottom of heat insulating cover for melting pot 4 is covered on the top edge of the melting pot 3 and on the step surface of the cell lining. The upper end of the heat insulating cover for melting pot 4 is flush with the cell lining in height. The heat insulating cover for melting pot 4 can be made of heat-insulation and anti-corrosion alumina ceramics, high alumina cement, anti-corrosion nitride or carbide material and so on. The heat insulating cover for melting pot 4 is covered on the melting pot 3 for heat insulating insulation.

The electrolytic cell comprises one group of column electrodes or several groups of column electrodes, and each group of column electrodes comprises two to several tens electrodes. Each electrode comprises an inert anode 11 and a cathode 12. The inert anode 11 is made of metal alloy, which is composed of copper, cobalt, nickel, iron, aluminum, rare earth metal, active metal, noble metal and so on. The cathode is the $TiB_2$ composite ceramics, the carbon block, of which the surface is covered with the $TiB_2$ coating, or other boride composite cathodes. The upper ends of both the inert anode 11 and the cathode 12 are provided with threaded holes for connection with the electrode stem. The group of column electrodes is perpendicularly and parallelly arranged in the electrolytic cell with the inert anode and the cathode connected in parallel. The electrode is arranged in the form of "-inert anode-cathode-inert anode-" or "-cathode-inert anode-cathode-" and the electrode distance is 10 mm~80 mm, such as the electrode distance is 30 mm. In one preferred embodiment, the electrolytic cell comprises 2 groups of column electrodes, wherein one group of column electrodes comprises 7 electrodes (4 blocks inert anodes and 3 blocks cathodes) and the electrode is arranged in the form of "-inert anode-cathode-inert anode-".

The bus-bars comprise an anode bus-bar 5, a cathode bus-bar 6, an anode branching bus-bar 9 and a cathode branching bus-bar 10. The anode branching bus-bar and the cathode branching bus-bar of each group of column electrodes are arranged in the form of "-anode branching bus-bar-cathode branching bus-bar-anode branching bus-bar-" or "-cathode branching bus-bar-anode branching bus-bar-cathode branching bus-bar-", two ends arranged are fixed on the anode bus-bar 5 and the cathode bus-bar 6. The anode branching bus-bar 9 is insulated with the cathode bus-bar 6 with the spacer made of polytetrafluoroethylene or other insulating materials; and the cathode branching bus-bar 10 is insulated with the anode bus-bar 5 with the spacer made of polytetrafluoroethylene or other insulating materials. The two-ended power supply mode is adopted for the group of column electrodes. Each group of column electrodes is provided with two-ended power supply mode: the two-ended power supply mode is formed by two anode bus-bars 5 and the cathode bus-bars 6, the group of column electrodes is divided into two layers, where one is the anode bus-bar 5 and the other is cathode bus-bar 6, the two ends of the anode branching bus-bar 9 are respectively fixed on the anode bus-bar 5, and the two ends of the cathode branching bus-bar 10 are respectively fixed on the cathode bus-bar 6.

Figure 3:
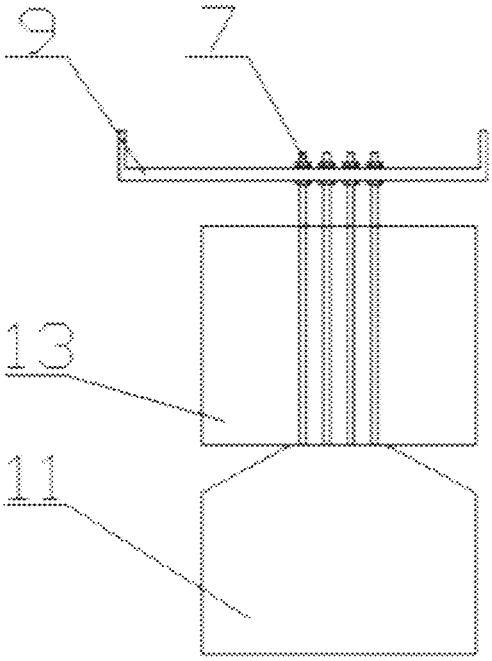
FIG. 3 is the assembly drawing for inert anode provided in the embodiment 1 of the present invention.
Figure 4:
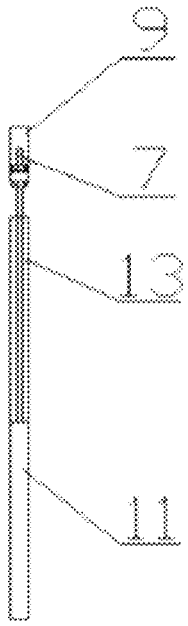
FIG. 4 is the side view for inert anode provided in the embodiment 1 of the present invention.

The electrode stem comprises an anode stem 7 and a cathode stem 8. The anode stem 7 and the cathode stem 8 are round bars made of stainless steel, heat-resisting alloy or anti-corrosion copper alloy, with screw at the lower end. The lower ends of the anode stem 7 and the cathode stem 8 are screwed into the threaded hole connecting the upper of the inert anode 11 and the cathode 12. The anode stem 7 and the cathode stem 8 can also be provided with screw at the upper end, the upper ends of the anode stem 7 and the cathode stem 8 can be inserted into corresponding holes of the anode branching bus-bar 9 (as shown in FIG. 3 and FIG. 4) or the cathode branching bus-bar 10, and fixed with screw caps and spring spacers. The upper ends of the anode stem 7 and the cathode stem 8 can also be connected with the anode branching bus-bar 9 or the cathode branching bus-bar 10 through the crimping with fixtures, welding and other methods. In the embodiment, the inert anode 11 is connected with the branching bus-bar with 4 anode stems 7, and the cathode 12 is connected with the branching bus-bar with 8 cathode stems 8. The outside of the electrode stem can be protected with the protecting tube (for example, the outside of the cathode stem 8 is protected with the protecting tube). The interspace between the protecting tube and the electrode stem is filled with aluminum oxide. The protecting tube can be the alundum tube, carborundum tube or can be made of other anti-corrosion and heat-resisting materials. The outside of the electrode stem can also be protected with the quadrate heat insulating material, which is provided with via holes in the middle in order to prevent oxidation and insulate heat.

The heat insulating plate 13 and the partition between anode and cathode 14 are made of heat-insulation and anti-corrosion ceramics. The width and thickness of the heat insulating plate 13 are the same as those of the electrode. The heat insulating plate 13 is provided with a row of via holes in the vertical direction, through which the electrode stem can pass through the heat insulating plate. The heat insulating plate 13 can be placed above the electrode. The width of the partition between anode and cathode 14 is equal to the width of the electrode, the thickness of the partition between anode and cathode 14 is 30 mm, the partition between anode and cathode 14 is suspended under a sealing plate 16 and placed in the middle of electrodes, and it is closely arranged with the heat insulating plate 13 in order to ensure the electrode distance, and it is used to fix electrodes, seal and insulate heat. The heat insulating plate in the feeding area 15 is made of heat-insulation and anti-corrosion ceramics and is located between the crustbreaking hammerhead 20 and the heat insulating plate 13 over the group of column electrodes. The sealing plate 16 is made of steel plate and is overlapped between the anode branching bus-bar 9 and the cathode branching bus-bar 10 and is compacted on the anode branching bus-bar 9 and the cathode branching bus-bar 10 by means of the weight of the partition between anode and cathode 14. The sealing plate 16 is compacted with the branching bus-bar with the spacer made of high-temperature-resistance rubber or inorganic adhesive, inorganic felt and so on, and is used to seal and insulate.

The crustbreaking feeding part is composed of a crustbreaking cylinder 18, a crustbreaking heat-insulation and anti-radiance plate 19, a crustbreaking hammerhead 20 and a feeding tank 21 and so on. The line-type feeding is adopted for feeding mode, and the feeding port is in the middle of the electrolytic cell. The crustbreaking heat-insulation and anti-radiance plate 19 is used to be for heat insulating and antiradiance. The heat-insulation and anti-radiance plate 19 is made of heat-resisting stainless steel or other heat-resisting and anti-corrosion materials, and it is fixed on the connecting rod between the crustbreaking hammerhead 20 and the crustbreaking cylinder 18 to prevent heat loss and protect the crustbreaking cylinder 18 against overheat due to heat insulating radiation.

Embodiment 2

Figure 5:
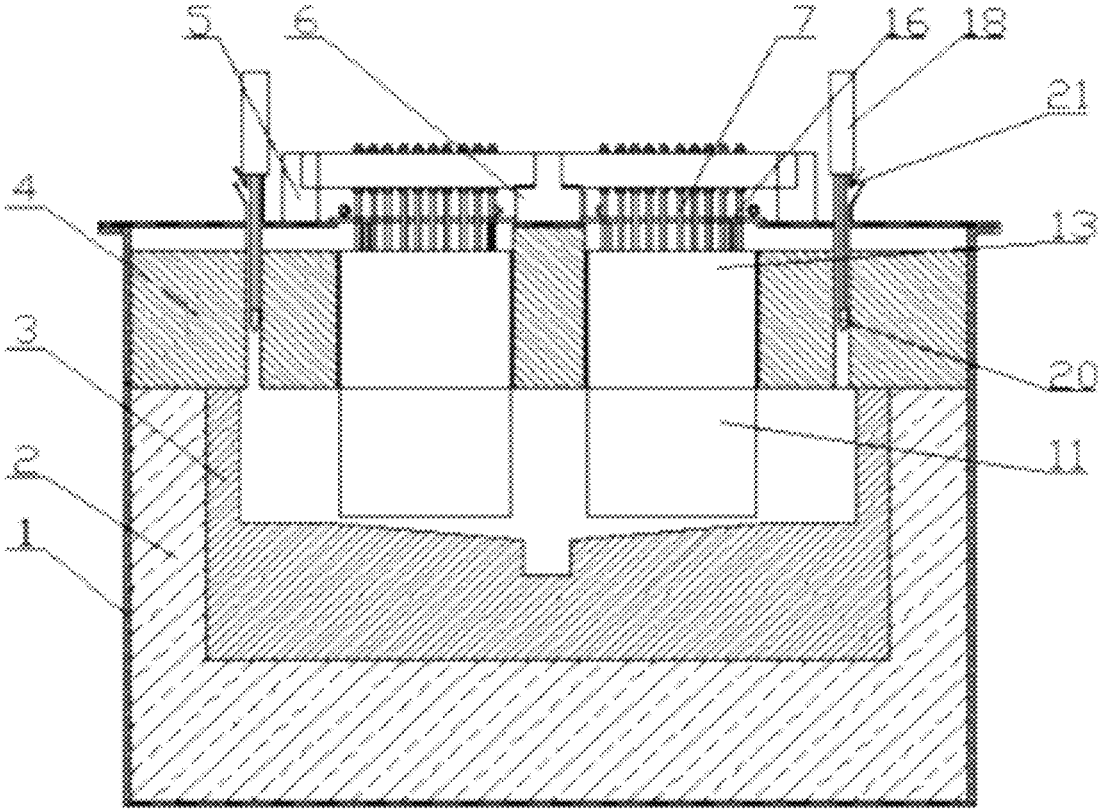
FIG. 5 is the front structural sectional view for an electrolytic cell for producing primary aluminum by using inert anode provided in the embodiment 2 of the present invention.
Figure 6:
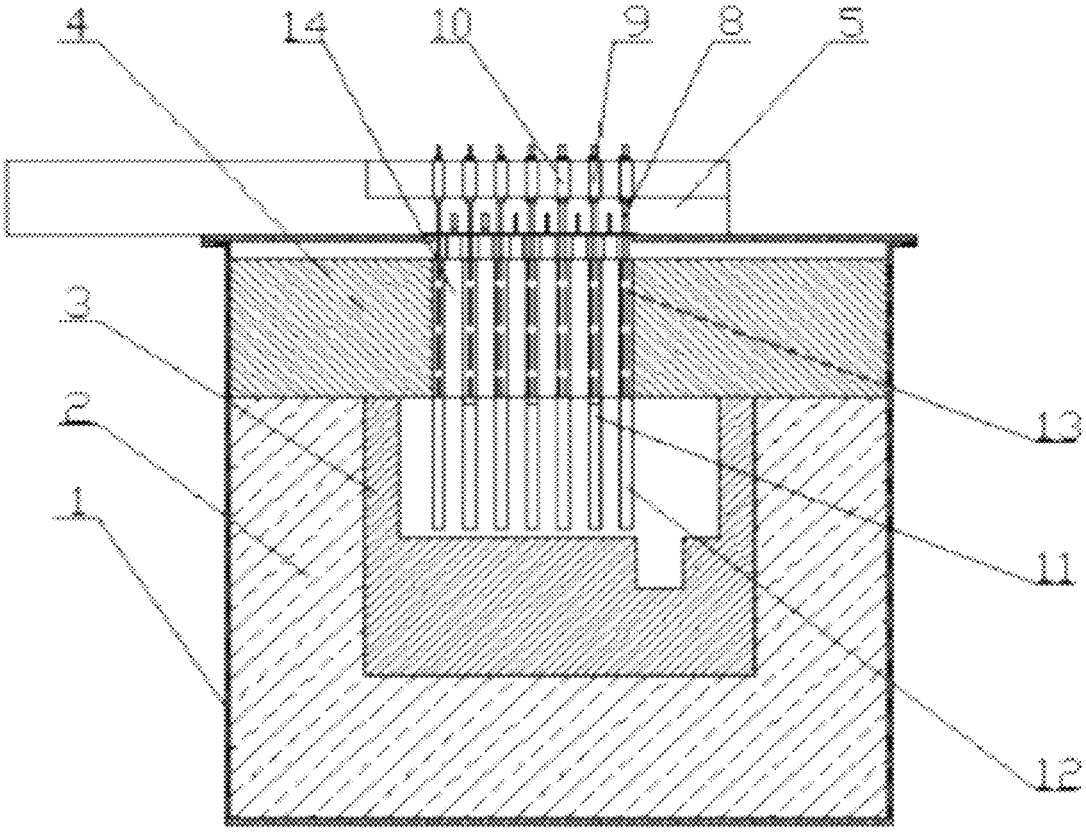
FIG. 6 is the side structural sectional view for an electrolytic cell for producing primary aluminum by using inert anode provided in the embodiment 2 of the present invention.

As shown in FIG. 5 and FIG. 6, the electrolytic cell comprises a cell shell 1, a melting pot 3, a heat insulating cover for melting pot 4, a cell lining 2, at least one group of column electrodes fixed in the electrolytic cell, a bus-bar, at least an electrode stem, a heat insulating plate 13, a partition between anode and cathode 14, a heat insulating plate in the feeding area 15, a sealing plate 16, a crustbreaking cylinder 18, a crustbreaking heat-insulation and anti-radiance plate 19, a crustbreaking hammerhead 20 and a feeding tank 21.

Furthermore, a molten pool of the electrolytic cell is composed of the cell shell 1, the cell lining 2, the melting pot 3 and the heat insulating cover for melting pot 4. The cell shell 1 is a closed shell made of steel plate, which is provided with the electrode port and feed opening on the upper part. The cell lining is built with the refractory heat insulating material coating 2 as well as the inner bottom surface and lateral surface of the cell shell. The inside cavity of the upper end of the cell lining is in the expanding diameter step shape. The heat insulating cover for melting pot 4 is made of heat-insulation and anti-corrosion alumina ceramics, high alumina cement or anti-corrosion nitride, carbide material and so on. The heat insulating cover for melting pot 4 is covered on the melting pot 3 for heat insulating. The melting pot 3 is spliced with the heterogenic anti-corrosion internal lining material blocks or bricks. The melting pot 3 is located in the middle part of the cell, and the outer wall of the melting pot is fitted with the cell lining. There are an inclination angle at the bottom of the melting pot 3 and a diversion groove in the middle of the melting pot 3. One end of the melting pot 3 is provided with a storage aluminum pool. The molten aluminum generated by the electrolysis flows into the diversion groove along the inclined plane, and finally flows into the storage aluminum pool. Therefore, the aluminum-free level operation or low aluminum level operation can be realized. The heat insulating cover for melting pot 4 can be a quadrate cover or circular cover. The bottom of heat insulating cover for melting pot 4 is covered on the top edge of the melting pot 3. The upper end of the heat insulating cover for melting pot 4 can be horizontally extended to the edge of the cell shell and covered over the cell lining. The passage for feeding and crustbreaking is reserved in the heat insulating cover for melting pot 4. The heat insulating cover for melting pot 4 can be made of heat-insulation and anti-corrosion alumina ceramics, high alumina cement, anti-corrosion nitride or carbide material and so on. The heat insulating cover for melting pot 4 is covered on the melting pot 3 for heat insulating.

The electrolytic cell comprises one group of column electrodes or several groups of column electrodes, and each group of column electrodes comprises two to several tens electrodes. Each electrode comprises an inert anode 11 and a cathode 12. The inert anode 11 is made of metal alloy, which is composed of copper, cobalt, nickel, iron, aluminum, rare earth metal, active metal, noble metal and so on. The cathode is the $TiB_2$ composite ceramics, the carbon block, of which the surface is covered with the $TiB_2$ coating, or other boride composite cathodes. The upper ends of both the inert anode 11 and the cathode 12 are provided with threaded holes for connection with the electrode stem. The group of column electrodes is perpendicularly and parallelly arranged in the electrolytic cell with the inert anode and the cathode connected in parallel. The electrode is arranged in the form of "-inert anode-cathode-inert anode-" or "-cathode-inert anode-cathode-" and the electrode distance is 10 mm~80 mm, such as the electrode distance is 40 mm. In one preferred embodiment, the electrolytic cell comprises 2 groups of column electrodes, wherein one group of column electrodes comprises 7 electrodes (4 blocks inert anodes and 3 blocks cathodes) and the electrode is arranged in the form of "-inert anode-cathode-inert anode-".

The bus-bars comprise an anode bus-bar 5, a cathode bus-bar 6, an anode branching bus-bar 9 and a cathode branching bus-bar 10. The anode branching bus-bar and the cathode branching bus-bar of each group of column electrodes are arranged in the form of "-anode branching bus-bar-cathode branching bus-bar-anode branching bus-bar-" or "-cathode branching bus-bar-anode branching bus-bar-cathode branching bus-bar-", two ends arranged are fixed on the anode bus-bar 5 and the cathode bus-bar 6. The anode branching bus-bar 9 is insulated with the cathode bus-bar 6 with the spacer made of polytetrafluoroethylene or other insulating materials; and the cathode branching bus-bar 10 is insulated with the anode bus-bar 5 with the spacer made of polytetrafluoroethylene or other insulating materials. The single-ended power supply mode is adopted for the group of column electrodes. Each group of column electrodes is provided with single-ended power supply mode: the single-ended power supply mode is formed by one anode bus-bars (power input end) and one cathode bus-bars (power output end), the two ends of the anode branching bus-bar are respectively fixed on the anode bus-bar, the two ends of the cathode branching bus-bar are respectively fixed on the cathode bus-bar, and the insulating strips are used for insulation of the interface between the anode branching bus-bar and the cathode bus-bar, and the base plane between the cathode branching bus-bar and the anode bus-bar. The cathode bus-bars of two groups of column electrodes in the Figures are combined as one total cathode bus-bar.

The electrode stem comprises an anode stem 7 and a cathode stem 8. The anode stem 7 and the cathode stem 8 are round bars made of stainless steel, heat-resisting alloy or anti-corrosion copper alloy, with screw at the lower end. The lower ends of the anode stem 7 and the cathode stem 8 are screwed into the threaded hole connecting the upper of the inert anode 11 and the cathode 12. The anode stem 7 and the cathode stem 8 can also be provided with screw at the upper end, the upper ends of the anode stem 7 and the cathode stem 8 can be inserted into corresponding holes of the anode branching bus-bar 9 (as shown in FIG. 3 and FIG. 4) or the cathode branching bus-bar 10, and fixed with screw caps and spring spacers. The upper ends of the anode stem 7 and the cathode stem 8 can also be connected with the anode branching bus-bar 9 or the cathode branching bus-bar 10 through the crimping with fixtures, welding and other methods. In the embodiment, the inert anode 11 is connected with the branching bus-bar with 10 anode stems 7, and the cathode 12 is connected with the branching bus-bar with 10 cathode stems 8. The outside of the electrode stem can be protected with the protecting tube (for example, the outside of the cathode stem 8 is protected with the protecting tube). The interspace between the protecting tube and the electrode stem is filled with aluminum oxide. The protecting tube can be the alundum tube, carborundum tube or can be made of other anti-corrosion and heat-resisting materials. The outside of the electrode stem can also be protected with the quadrate heat insulating material, which is provided with via holes in the middle in order to prevent oxidation and insulate heat.

The heat insulating plate 13 and the partition between anode and cathode 14 are made of heat-insulation and anti-corrosion ceramics. The width and thickness of the heat insulating plate 13 are the same as those of the electrode. The heat insulating plate 13 is provided with a row of via holes in the vertical direction, through which the electrode stem can pass through the heat insulating plate. The heat insulating plate 13 can be placed above the electrode. The width of the partition between anode and cathode 14 is equal to the width of the electrode, the thickness of the partition between anode and cathode 14 is 40 mm, the partition between anode and cathode 14 is suspended under a sealing plate 16 and placed in the middle of electrodes, and it is closely arranged with the heat insulating plate 13 in order to ensure the electrode distance, and it is used to fix electrodes, seal and insulate heat. The sealing plate 16 is made of steel plate and is overlapped between the anode branching bus-bar 9 and the cathode branching bus-bar 10 and is compacted on the anode branching bus-bar 9 and the cathode branching bus-bar 10 by means of the weight of the partition between anode and cathode 14. The sealing plate 16 is compacted with the branching bus-bar with the spacer made of high-temperature-resistance rubber or inorganic adhesive, inorganic felt and so on, and is used to seal and insulate.

The crustbreaking feeding part is composed of a crustbreaking cylinder 18, a crustbreaking hammerhead 20 and a feeding tank 21 and so on. The line-type feeding is adopted for feeding mode, and the feeding port is at both sides of the electrolytic cell.

The present invention embodiment provides an electrolytic cell for producing primary aluminum by using inert anodes, compared with the traditional aluminum electrolysis process, which is green environmental protection, the cell is from emission of $O_2$ and free from emission of $CO_2$ and PFCs (perfluorinated compounds), hardly has consumption of electrodes, so the yearly corrosion rate is low, the distances between the anodes and cathodes can be kept stable, the interference on the current distribution and heat balance is avoided due to the anode replacement, and the cell is easy to be controlled; the electrolytic cell has good heat insulation effect, increased heat efficiency, and reduced heat loss; no carbon processing plant needs to be additionally constructed, reduced the cost and the replacement frequency of anodes, as well as the amount of operating human; the metal quality of the product is increased, so that the product quality of primary aluminum is not less than 99.7% after the inert electrode is used, and increased space utilization rate and capacity in unit volume or unit floor space of the cell; the electrolytic cell is free of tank leakage, and it has long service life; the electrolytic cell is sealed and the volatilization of dust and fluorides can be prevented, and it is useful to recover oxygen gas.

The above-mentioned embodiment is only preferred embodiment of the present invention and shall not be used to limit the present invention. Any improvement, modification, replacement, combination and simplification within the spirit and principle of the present invention shall be considered as equivalent replacement and within the protection scope of the present invention.

What is claimed is:

1. An electrolytic cell for producing primary aluminum by using inert anodes, wherein the electrolytic cell comprises a cell shell, at least one group of column electrodes fixed in the electrolytic cell, a bus-bar, at least an electrode stem, a heat insulating plate, a partition disposed between anode and cathode, and used to fix electrodes, seal and insulate heat and disposed between anode and cathode, and a sealing plate; said electrode group comprises at least 2 electrodes;

single said electrode comprises an inert anode and a cathode, which is arranged in the form of "-inert anode-cathode-inert anode-" or "-cathode-inert anode-cathode-";

said bus-bar comprises an anode bus-bar, a cathode bus-bar, an anode branching bus-bar and a cathode branching bus-bar; the anode branching bus-bar and the cathode branching bus-bar of said electrode group are arranged in the form of "-anode branching bus-bar-cathode branching bus-bar-anode branching bus-bar-"

or "-cathode branching bus-bar-anode branching bus-bar-cathode branching bus-bar-";

single said electrode is connected with said anode branching bus-bar or said cathode branching bus-bar through said electrode stem;

said heat insulating plate is fixed above said inert anode and said heat insulating plate is provided with via holes, through which said electrode stem can pass through said heat insulating plate;

said partition between anode and cathode is fixed under said sealing plate and in the middle of the electrodes, and it is closely arranged with said heat insulating plate, so as to ensure the electrode distance; and said sealing plate is overlapped between said anode branching bus-bar and said cathode branching bus-bar and is compacted on the anode branching bus-bar and the cathode branching bus-bar by means of the weight of the partition between anode and cathode;

wherein further comprising a cell lining, said cell lining is built with refractory and heat insulating material coating, and the inside cavity of the upper end of said cell lining is in an expanding diameter step shape;

wherein further comprising a melting pot, said melting pot is located in the middle part of the cell; and the outer wall of said melting pot is fitted with said cell lining; and wherein there is a storage aluminum pool at one end of said melting pot bottom, said storage aluminum pool is connected with an aluminum collector groove fixed under a cathode shadow through a diversion groove, the bottom of said melting pot is an inclined plane through which molten aluminum can flow into the diversion groove fixed in the middle part or at both sides of the melting pot and can be collected into the storage aluminum pool.

2. The electrolytic cell for producing primary aluminum by using inert anodes of claim 1, wherein the lower end of said electrode stem is connected with said inert anode and said cathode by bolt joint, casting or welding.

3. The electrolytic cell for producing primary aluminum by using inert anodes of claim 1, wherein the upper end of said electrode stem is connected with said anode branching bus-bar or said cathode branching bus-bar by bolt joint, compression joint or welding.

4. The electrolytic cell for producing primary aluminum by using inert anodes of claim 1, wherein said electrode stem is made of stainless steel, heat-resisting alloy or anti-corrosion copper alloy.

5. The electrolytic cell for producing primary aluminum by using inert anodes of claim 1, wherein a protecting tube is fixed at the outside of said electrode stem, and the inter space between said protecting tube and said electrode stem is filled with aluminum oxide.

6. The electrolytic cell for producing primary aluminum by using inert anodes of claim 5, wherein said protecting tube is made of alundum tubes, carborundum tubes or other anti-corrosion and heat-resisting materials.

7. The electrolytic cell for producing primary aluminum by using inert anodes of claim 1, wherein the outside of said electrode stem is protected with quadrate heat insulating material that is provided with via holes in the middle.

8. The electrolytic cell for producing primary aluminum by using inert anodes of claim 1 wherein said heat insulating plate is made of heat-insulation and anti-corrosion ceramics; and the width and thickness of said heat insulating plate are the same as those of the electrode.

9. The electrolytic cell for producing primary aluminum by using inert anodes of claim 1 wherein said partition between anode and cathode is made of heat-insulation and anti-corrosion ceramics; the width of said partition between anode and cathode is the same as that of the electrode; the thickness of said partition between anode and cathode is equal to the electrode distance; and said partition between anode and cathode is suspended under said sealing plate.

10. The electrolytic cell for producing primary aluminum by using inert anodes of claim 1 wherein said sealing plate is compacted on said anode branching bus-bar and said cathode branching bus-bar by means of fixtures; said sealing plate is compacted between said anode branching bus-bar and said cathode branching bus-bar with a gasket.

11. The electrolytic cell for producing primary aluminum by using inert anodes of claim 10 wherein said gasket comprises high-temperature rubber, inorganic adhesive or inorganic felt.

12. The electrolytic cell for producing primary aluminum by using inert anodes of claim 1, wherein said inert anode is made of metal alloy; said cathode is TiB2 composite ceramics, a carbon block, of which the surface is covered with the TiB2 coating, or other boride composite cathodes.

13. The electrolytic cell for producing primary aluminum by using inert anodes of claim 11 wherein the electrode distance of said electrode is 10 mm~80 mm.

14. The electrolytic cell for producing primary aluminum by using inert anodes of claim 1, wherein said anode branching bus-bar is insulated with said cathode bus-bar with a spacer made of polytetrafluoroethylene or other insulating materials.

15. The electrolytic cell for producing primary aluminum by using inert anodes of claim 1, wherein said cathode branching bus-bar is insulated with said anode bus-bar with a spacer made of polytetrafluoroethylene or other insulating materials.

16. The electrolytic cell for producing primary aluminum by using inert anodes of claim 1, wherein said inert anode and said cathode are perpendicularly and parallelly fixed in the electrolytic cell in a parallel manner.

17. The electrolytic cell for producing primary aluminum by using inert anodes of claim 1, wherein further comprising a heat insulating cover for the melting pot, the bottom of said heat insulating cover for the melting pot is covered on the top edge of the melting pot and on the step surface of said cell lining, and the upper end of the heat insulating cover for the melting pot is flush with said cell lining in height and is horizontally extended to the periphery of the cell shell and covered over the cell lining.

18. The electrolytic cell for producing primary aluminum by using inert anodes of claim 17 wherein said heat insulating cover for the melting pot is a quadrate cover or circular cover.

19. The electrolytic cell for producing primary aluminum by using inert anodes of claim 17, wherein said heat insulating cover for the melting pot is made of heat-insulation and anti-corrosion alumina ceramics, high alumina cement, anti-corrosion nitride or carbide materials.

20. The electrolytic cell for producing primary aluminum by using inert anodes of claim 1, wherein said cell shell is provided with a feeding opening, said feeding opening is located in the middle part and/or lateral part of the electrolytic cell, and the point-type feeding and/or line-type feeding are/is adopted.

21. The electrolytic cell for producing primary aluminum by using inert anodes of claim 20 wherein said feeding opening is fixed with a crustbreaking feeding device, and the lower end of said crustbreaking feeding device is fixed with a crustbreaking heat-insulation and anti-radiance plate.

22. An electrolytic cell for producing primary aluminum by using inert anodes, wherein the electrolytic cell comprises a cell shell, at least one group of column electrodes fixed in the electrolytic cell, a bus-bar, at least an electrode stem, a heat insulating plate, a partition between anode and cathode, and a sealing plate; said electrode group comprises at least 2 electrodes;

single said electrode comprises an inert anode and a cathode, which is arranged in the form of "-inert anode-cathode-inert anode-" or "-cathode-inert anode-cathode-";

said bus-bar comprises an anode bus-bar, a cathode bus-bar, an anode branching bus-bar and a cathode branching bus-bar; the anode branching bus-bar and the cathode branching bus-bar of said electrode group are arranged in the form of "-anode branching bus-bar-cathode branching bus-bar-anode branching bus-bar-" or "-cathode branching bus-bar-anode branching bus-bar-cathode branching bus-bar-";

single said electrode is connected with said anode branching bus-bar or said cathode branching bus-bar through said electrode stem;

said heat insulating plate is fixed above said inert anode and said heat insulating plate is provided with via holes, through which said electrode stem can pass through said heat insulating plate;

said partition between anode and cathode is fixed under said sealing plate and in the middle of the electrodes, and it is closely arranged with said heat insulating plate, so as to ensure the electrode distance; and said sealing plate is overlapped between said anode branching bus-bar and said cathode branching bus-bar;

wherein said cell shell is provided with a feeding opening, said feeding opening is located in the middle part and/or lateral part of the electrolytic cell, and the point-type feeding and/or line-type feeding are/is adopted; and wherein said feeding opening is fixed with a crustbreaking feeding device, and the lower end of said crustbreaking feeding device is fixed with a crustbreaking heat-insulation and anti-radiance plate.

* * * * *